US006536422B1

(12) United States Patent
Zuzelo et al.

(10) Patent No.: US 6,536,422 B1
(45) Date of Patent: Mar. 25, 2003

(54) SAW FOR CUTTING GREEN CONCRETE

(76) Inventors: Edward A. Zuzelo, 622 Broad Acres Rd., Narbeth, PA (US) 19072; Albert D. Alderman, Jr., Township Line Rd., Skippack, PA (US) 19474

( * ) Notice: Subject to any disclaimer, the term of this patent is extended or adjusted under 35 U.S.C. 154(b) by 0 days.

(21) Appl. No.: 09/645,891

(22) Filed: Aug. 25, 2000

(51) Int. Cl.[7] ..... B28D 1/02
(52) U.S. Cl. ..... 125/13.01; 451/350
(58) Field of Search ..... 451/344, 350, 451/352, 353; 125/13.01, 14, 13.03; 299/39.3

(56) References Cited

U.S. PATENT DOCUMENTS 4,938,201 A 7/1990 Chiuminatta et al.
5,056,499 A 10/1991 Chiuminatta et al.
5,241,946 A * 9/1993 Yelton et al. ..... 125/14
5,381,780 A * 1/1995 Yelton et al. ..... 125/14
5,809,985 A * 9/1998 Kingsley et al. ..... 125/13.01

FOREIGN PATENT DOCUMENTS

CH 257327 * 4/1949 ..... 125/13.01

* cited by examiner

*Primary Examiner*—Robert A. Rose
(74) *Attorney, Agent, or Firm*—LaMorte & Associates

(57) ABSTRACT

An apparatus for cutting concrete is provided and includes a frame having a plurality of support wheels located thereon. A prime mover assembly is connected to the frame, and a concrete cutting blade is drivingly connected to the prime mover. The blade is mounted for generally upward and downward movement relative to the frame for engaging and disengaging from a surface to be cut. A carriage having an anti-spalling roller mounted thereon is connected to the frame such that the carriage positions a surface contact portion of the anti-spalling roller in alignment with a blade exit location for an operative range of cutting depths.

15 Claims, 8 Drawing Sheets

SAW FOR CUTTING GREEN CONCRETE

BACKGROUND

The present invention relates to saws for cutting concrete and, more particularly, to saws for cutting grooves in green concrete to prevent random cracking.

Concrete slabs are prone to cracking as a result of expansion and contraction as they cure, and as a result of exposure to environmental temperature changes. Uncontrolled, such cracks can form anywhere within the concrete slab.

One method of controlling the formation and location of cracks in the slab is to provide a relatively shallow groove along the surface of the concrete. Since the slab is weakest along the cross sectional plane defined by such a groove, potential cracks are more likely to form within the plane defined by the groove than in the area containing no formed or saw cut groove. Providing regularly spaced grooves along the surface of a large concrete slab has become a widely accepted method of controlling the cracks and localizing the cracks within the groove where they will be less visible and aesthetically positioned.

Several methods and devices are known for creating grooves in the surface of newly poured concrete. One method is to form the grooves with a hand held tool, such as a trowel, while the concrete is still soft enough to be worked by hand. Another method uses a saw to cut a groove into the concrete while the concrete is green, i.e., still relatively soft, but hard enough to support such a device.

One such type of cutting device is disclosed U.S. Pat. No. 5,056,499. This patent discloses a concrete cutting device having a slotted skid plate through which a circular saw blade projects for cutting the concrete. The saw blade is mounted on a frame that is supported on the concrete surface by the skid plate and several wheels. The skid plate contacts the concrete adjacent the area being cut by the blade to prevent undesirable ravelling and chipping of the surface and maintain the integrity of the concrete surface near the cut. To cut the groove, the device is pushed across the surface of the concrete as the saw blade rotates. Because the device is supported by a skid plate in direct contact with the concrete surface, the device actually skids along the surface as it moves.

Concrete saws of the type described above have several disadvantages. Desirably, green concrete should be cut as early as possible without marring its surface. While devices of the type previously discussed are light in weight, sliding the skid plate across the surface of the concrete tends to mar the finish. Additionally, skidding, as opposed to rolling, requires additional force to propel the unit across the surface, increasing the tendency for the operator to push the cutting device down into the concrete, further marring the surface. Furthermore, the combination of a skid plate on one side of the cutting device and wheels on the other side can cause the saw device to yaw relative to the direction of travel. Such yawing skews the blade relative to the direction of travel resulting in a wider, more unsightly groove in the concrete and chipping and ravelling.

One previously proposed solution to this problem is a green concrete cutting saw that is mounted on a wheeled support, in which anti-spalling rollers are positioned generally adjacent to the blade exit point. However, the rollers were located at a set radial distance from the blade shaft on the blade guard. Depending upon the depth of cut, the rollers would not be aligned with the blade exit point from the surface of the green concrete being cut. This resulted in some chipping or spalling of the green concrete along the edge of the cut.

It would be desirable to provide a saw for cutting green concrete which eliminates this problem by maintaining the position of the anti-spalling rollers generally aligned with the blade exit point from the surface of the green concrete being cut throughout the operative cutting range of the saw.

It would also be desirable to prevent chipping and maintain the surface integrity of the concrete adjacent the groove as the cut is made.

SUMMARY

Briefly stated, the present invention provides an apparatus for cutting green concrete. The apparatus includes a frame having a plurality of support wheels located thereon. A prime mover assembly is connected to the frame, and a concrete cutting blade is drivingly connected to the prime mover, preferably through the use of a traction means such as a chain or belt. The blade is mounted for generally upward and downward movement relative to the frame for engaging and disengaging from a surface to be cut. A carriage having an anti-spalling roller mounted thereon is connected to the frame. The carriage position is simultaneously adjusted with the upward and downward movement of the blade such that a surface contact portion of the anti-spalling roller is maintained in alignment with a blade exit location for an operative range of cutting depths.

BRIEF DESCRIPTION OF THE DRAWINGS

The foregoing summary, as well as the following detailed description of the preferred embodiments of the invention will be better understood when read in conjunction with the appended drawings. For the purpose of illustrating the invention, there are shown in the drawings embodiments which are presently preferred. It should be understood, however, that the invention is not limited to the precise arrangements shown.

DETAILED DESCRIPTION OF THE PREFERRED EMBODIMENTS

Figure 1:
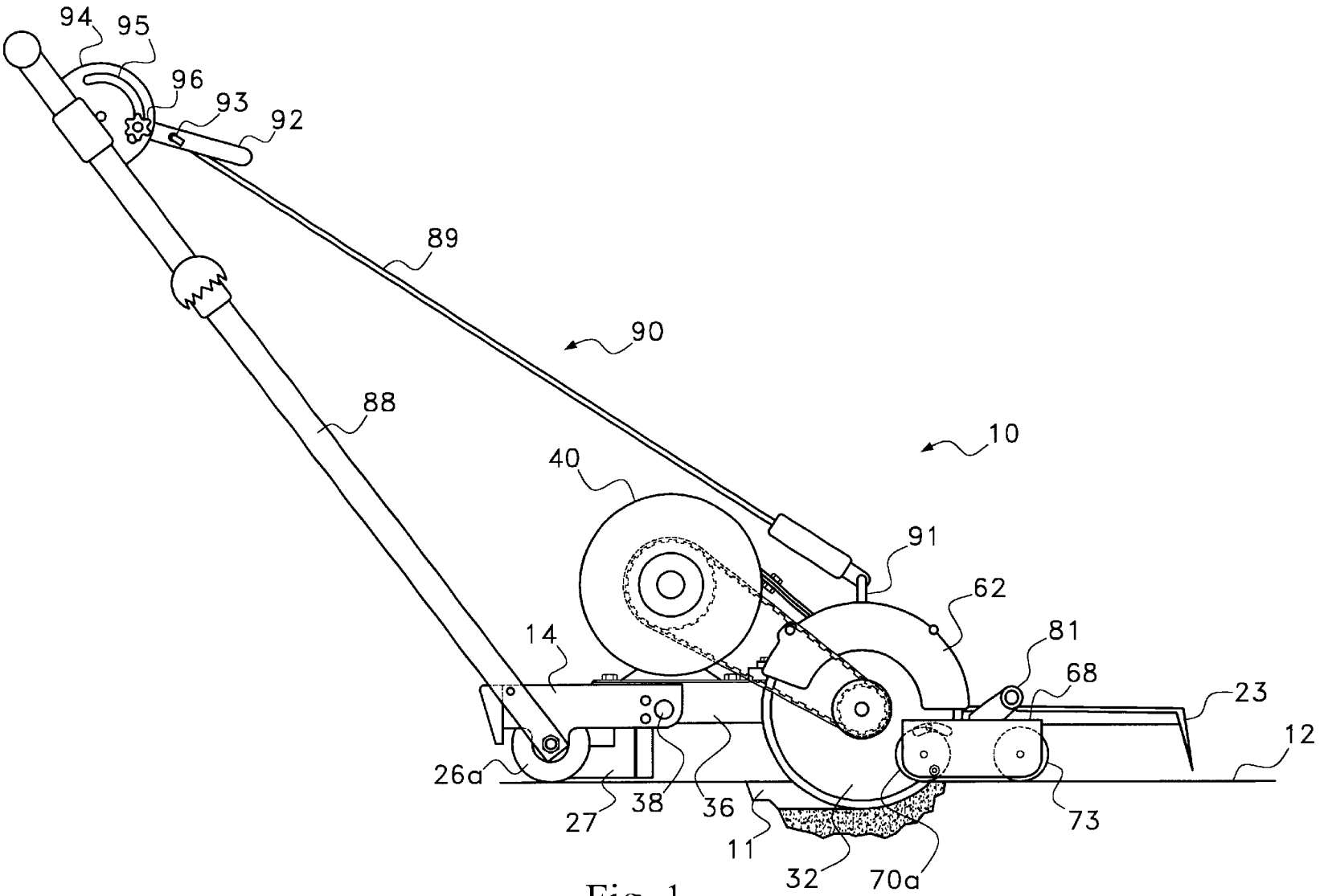
FIG. 1 is a side elevational view of a concrete saw in accordance with a preferred embodiment of the present invention.

Certain terminology is used in the following description for convenience only and is not considered limiting. The words "right," "left," "lower" and "upper" designate directions in the drawings to which reference is made. This terminology includes the words specifically noted above, derivatives thereof and words of similar import. Additionally, the terms "a" and "one" are defined as including one or more the referenced item unless specifically noted.

Figure 2:
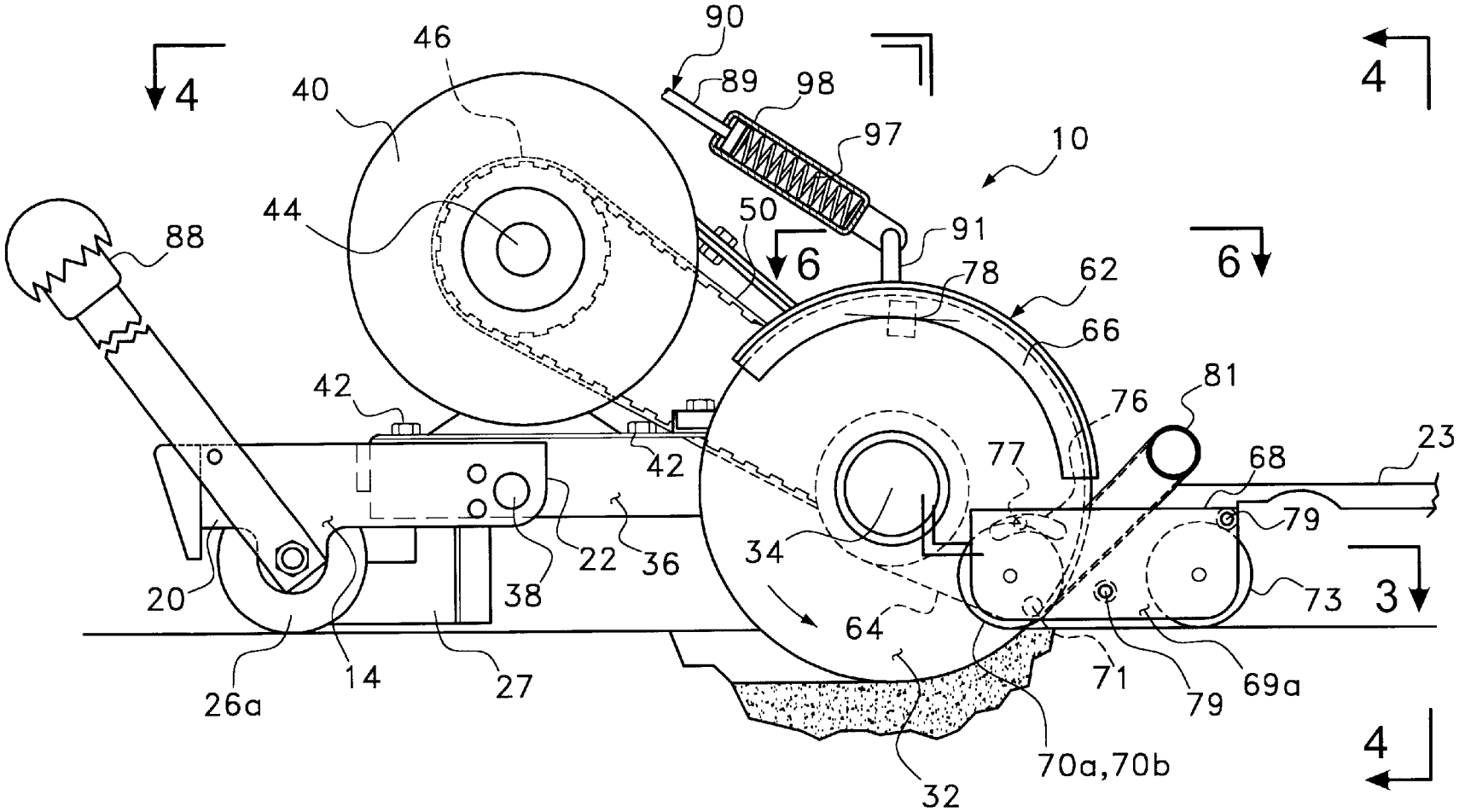
FIG. 2 is an enlarged side elevational view, shown partially in cross-section, of the concrete saw shown in FIG. 1.
Figure 3:
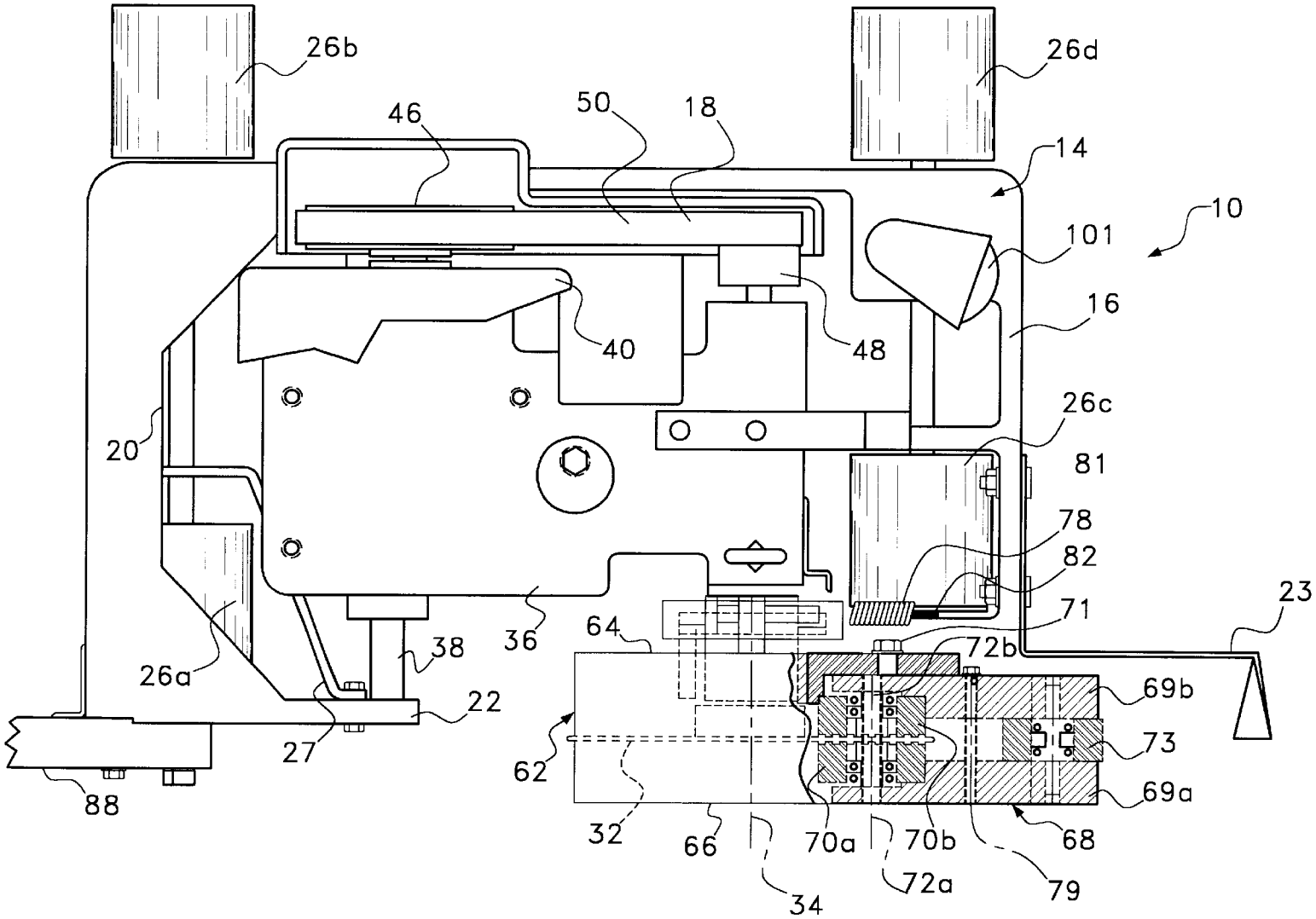
FIG. 3 is a top plan view, partially in cross-section as indicated in FIG. 2, of the concrete saw shown in FIG. 2.
Figure 5:
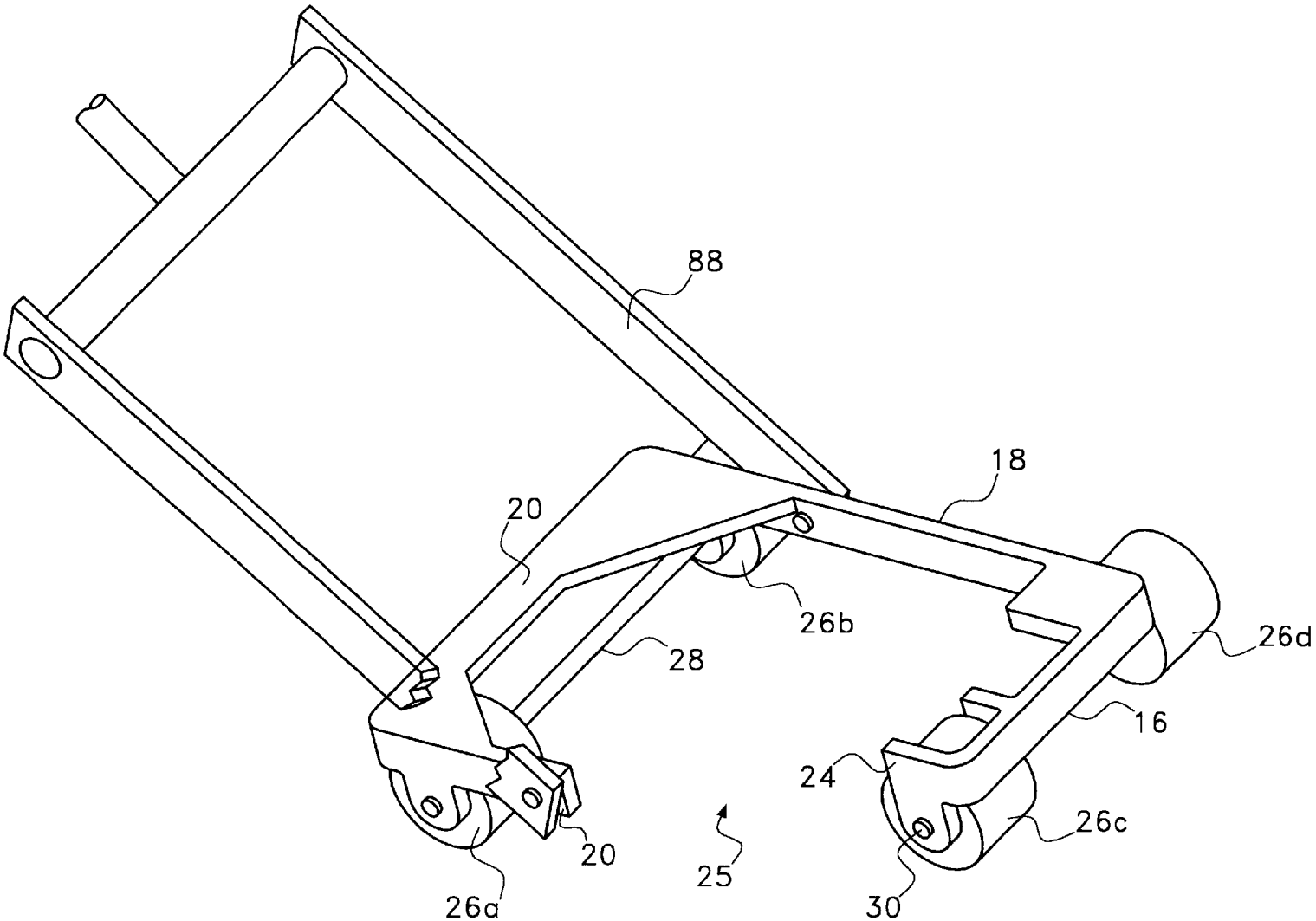
FIG. 5 is a perspective of a frame for the concrete saw shown in FIG. 1.
Figure 6:
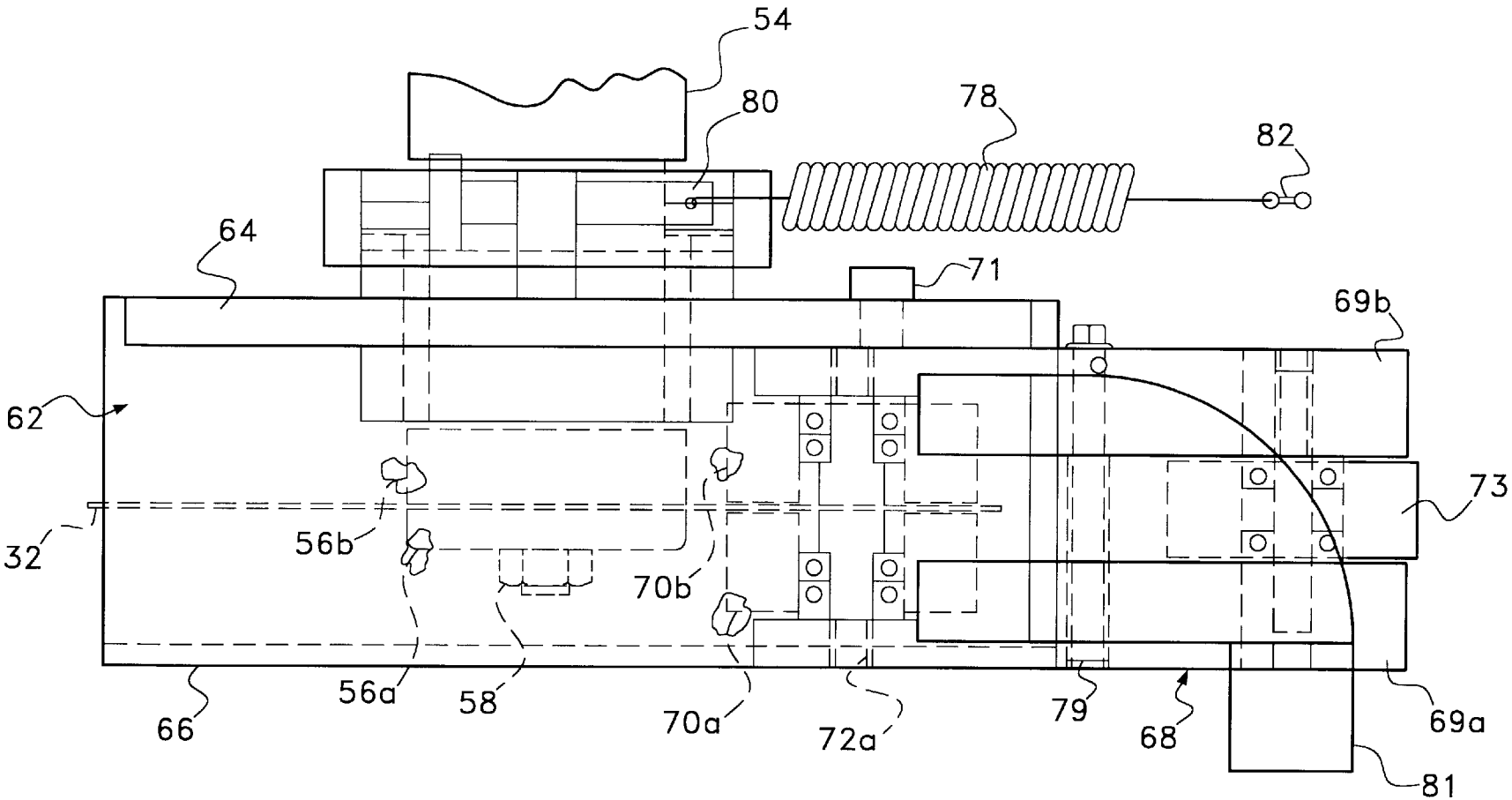
FIG. 6 is an enlarged top view taken along line 6—6 in FIG. 2.

Referring to FIGS. 1, 2 and 3, a concrete cutting device 10 for cutting a groove 11 in concrete 12 is shown. Cutting device 10 comprises a frame 14, preferably having a generally a rectangular form. The frame may be made of a metallic material, such as aluminum, and may be assembled as a weldment, cast, machined or otherwise assembled. As best shown in FIG. 5, the frame 14 has a front member 16, side member 18, rear member 20, rear partial side member 22, and front partial side member 24. A gap 25 between members 22 and 24 provides a space for the saw blade assembly which will be described below. It is understood that a continuous frame can be utilized as long as sufficient space is provided for the saw blade assembly.

Supporting the frame 14 are wheels 26*a*, 26*b*, 26*c* and 26*d*. Rear wheels 26*a* and 26*b* are rotatably mounted on rear axle 28 fixed to frame members 18 and 22. Front wheels 26*c* and 26*d* are rotatably mounted on front axle 30 fixed to frame members 24 and 18.

The wheels 26*a*, 26*b*, 26*c* and 26*d* are positioned relative to the frame 14 to provide maximum stability of the concrete saw 10 while proportionately distributing the device's weight over all the wheels. The size of the wheels should be sufficient to distribute the load carried.by each wheel over a large enough area to prevent indentation and damage to the green concrete surface. In the illustrated embodiment, the wheels may have, for example, a 3-inch width and a 3-inch diameter. As shown in FIG. 2, a plate 27 or other suitable device such as a brush is provided to clear away from the path of wheel 26*a* any cut concrete material which may interfere with the smooth rolling of the concrete saw 10.

Figure 4:
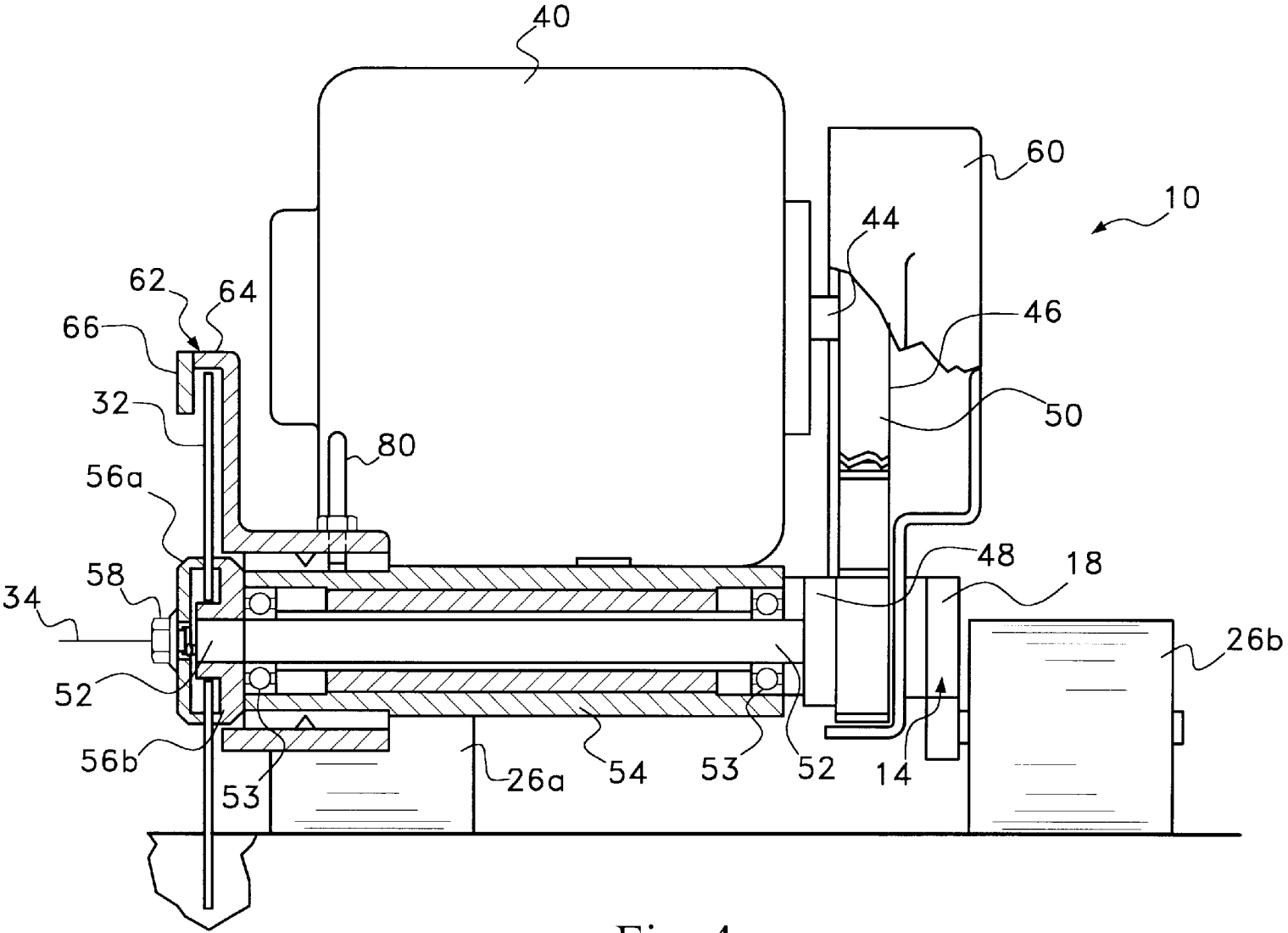
FIG. 4 is a front elevational view of the concrete saw taken along lines 4—4 in FIG. 2.

As best shown in FIGS. 2, 3 and 4, the saw blade assembly includes a prime mover 40 which is drivingly connected to a saw blade 32. The prime mover 40 is preferably an electric motor and is attached to a support assembly 36 by bolts 42. The support assembly 36 is pivotably mounted to the frame via a support axle 38. A traction means 50 is provided, such as a belt or chain, for transmitting power from the prime mover 40 to the saw blade 32. The traction means 50 is connected to a motor shaft 44 by a circular driver pulley 46, and extends to a driven pulley 48, best shown in FIGS. 3 and 4. The driven pulley 48 in turn is fixed to the blade shaft 52 which is rotatably attached to support assembly 36 by bearing 53 within a shaft housing 54. The saw blade 32 is fixedly attached to the blade shaft 52 by collars 56*a* and 56*b* and lock washer nut 58. However, other attachment means, such as a keyed arbor and blade opening could be utilized. It is thus seen that the prime mover 40 rotates the saw blade 32 by transmitting power to shaft 52 through the traction belt 50.

Drive systems incorporating circular pulleys and flexible belts are well known in the art and are commercially available. Available traction means for use with the drive system include flat belt, V-belt, link V-belt, timing belts, roller chain with sprockets drives, or any other suitable flexible drive. A V-belt drive as shown in the illustrated embodiment is preferred. It is also understood that alternative means for both powering and driving the saw blade can be used, such as gasoline powered engines, and/or gear driven transmissions for connecting the motor to the saw blade. A belt guard 60, shown partially broken away in FIG. 4 is desirable to protect the belt 50 from damage as well as to shield moving parts from a user to prevent injury.

The circular saw blade 32 has flat sides and can be made of any abrasive, such as carborundum, diamond coated steel, or any other suitable material capable of cutting green concrete. Such blades are well known in the art and are commercially available. In the illustrated embodiment, a 7-½ inch saw blade is shown. The saw blade 32 rotates about an axis 34 substantially perpendicular to the direction of travel of concrete saw 10. As illustrated in FIG. 2, the saw blade 32 rotates with an up-cut motion whereby the leading edge of the blade rotates out of concrete 12 at the point where the cut is made. Referring to FIG. 2, the blade 32 rotates counter-clockwise as the concrete saw 10 moves towards the right. An up-cut blade rotation removes the particles of cut concrete from the groove as the cut is made.

A down-cut rotation, on the other hand, pushes the particles of cut concrete into the groove 11 on the opposite side of the blade 32 from where the cut is made. It is believed, however, that such particles of concrete left in the groove will not bind within the groove 11. The heat generated by the cutting process along the cutting edge of the blade 32 may sufficiently cure the cut particles so that they can no longer bind. A filled groove, however, is unacceptable and should be cleaned of such particles once concrete 12 cures. An up-cut rotation is therefore preferable. The saw blade 32 and the drive system for rotating the saw blade are supported by blade assembly support 36. This is preferably formed of cast metal or structural members and is positioned within the generally rectangular box defined by frame 14. The assembly support 44 is pivotally mounted on support axle 38 that is fixed in adjacent frame members 18 and 22.

A blade guard 62, comprising an inner member 64 and an outer member 66 which are connected together, encloses a portion of the saw blade 32. As best shown in FIGS. 2–4, the guard 62 is pivotally connected to the cylindrical housing 54 to pivot around the blade 32. As shown in FIG. 2, the inner member 64 extends down to a position below the blade axis. The inner and outer members 64, 66 may be formed as one piece, such as a casting, or may be separate components that are assembled to form the blade guard 62.

Referring to FIGS. 2, 3, 6 and 7, a carriage 68 having at least one anti-spalling roller 70*a* mounted thereon is movably connected to the frame 36 such that the carriage positions a surface contact portion of the anti-spalling roller 70*a* in alignment with a blade exit location for an operative range of cutting depths. The anti-spalling roller 70*a* is adapted to prevent or reduce spalling, chipping and/or ravelling of the concrete along the edge(s) of the cut. Preferably, the carriage 68 is connected to the blade guard 62 via a pivotal connection 71 and two anti-spalling rollers 70*a*, 70*b* are provided, one on each side of the blade 32 to prevent or reduce spalling, chipping and/or ravelling along both edges of the cut. A forward roller 73 is mounted on the carriage 68 and a spring preferably biases the carriage about the pivotal connection such that the forward roller 73 is also adapted to contact the surface to be cut to position the anti-spalling roller(s) 70*a*, 70*b* in alignment with the blade exit location.

The carriage 68 includes a first stop element 76, and the blade guard 62 includes a second complementary stop element 77 to limit the travel of the carriage 68 relative to the guard. Preferably, the first stop element 76 is an arcuate groove and the second complementary stop element 77 is a pin which is located in the groove 76. However, it will be recognized by those skilled in the art that other types of stops could be utilized, or that the positions of the pin and groove could be reversed. The carriage 68 is preferably formed from two halves 69*a*, 69*b*, as shown in FIG. 3, and the position of the halves 69*a*, 69*b* can be adjusted via adjustment screws 79 to accommodate different blade widths such that the anti-spalling rollers 70*a*, 70*b* are positionable adjacent to the blade 32 with a minimum clearance. The anti-spalling rollers 70*a* and 70*b* are rotatably connected by axles 72*a*, 72*b* to the respective inner and outer halves 69*a*, 69*b* of the carriage 68, such that movement of the carriage halves 69*a*, 69*b* relative to one another results in the anti-spalling rollers 70*a*, 70*b* being moved closer to or farther from the blade 32. This allows for precise clearances between the blade 32 and the anti-spalling rollers 70*a*, 70*b* to ensure a clean edge adjacent to the cut. While one anti-spalling roller 70*a* can be utilized to prevent spalling on only one side of the same cut 11, two anti-spalling rollers 70*a*, 70*b* are preferred.

A dust chute 81 is connected to the carriage 68 to direct the material removed by the blade 32 away from the equipment. While the dust chute 81 is connected to the carriage 68 in the illustrated embodiment, it could also be connected to the blade guard 62 or frame 36, if desired.

As shown in FIG. 3, a spring 78 is connected at one end to a projection 80 on guard 62, and attached at the other end to a projection 82 on the frame member 24. Referring to FIG. 2, the spring 78 is in tension, urging the guard 62 to pivot clockwise about the axis 34 towards the concrete 12.

Figure 7:
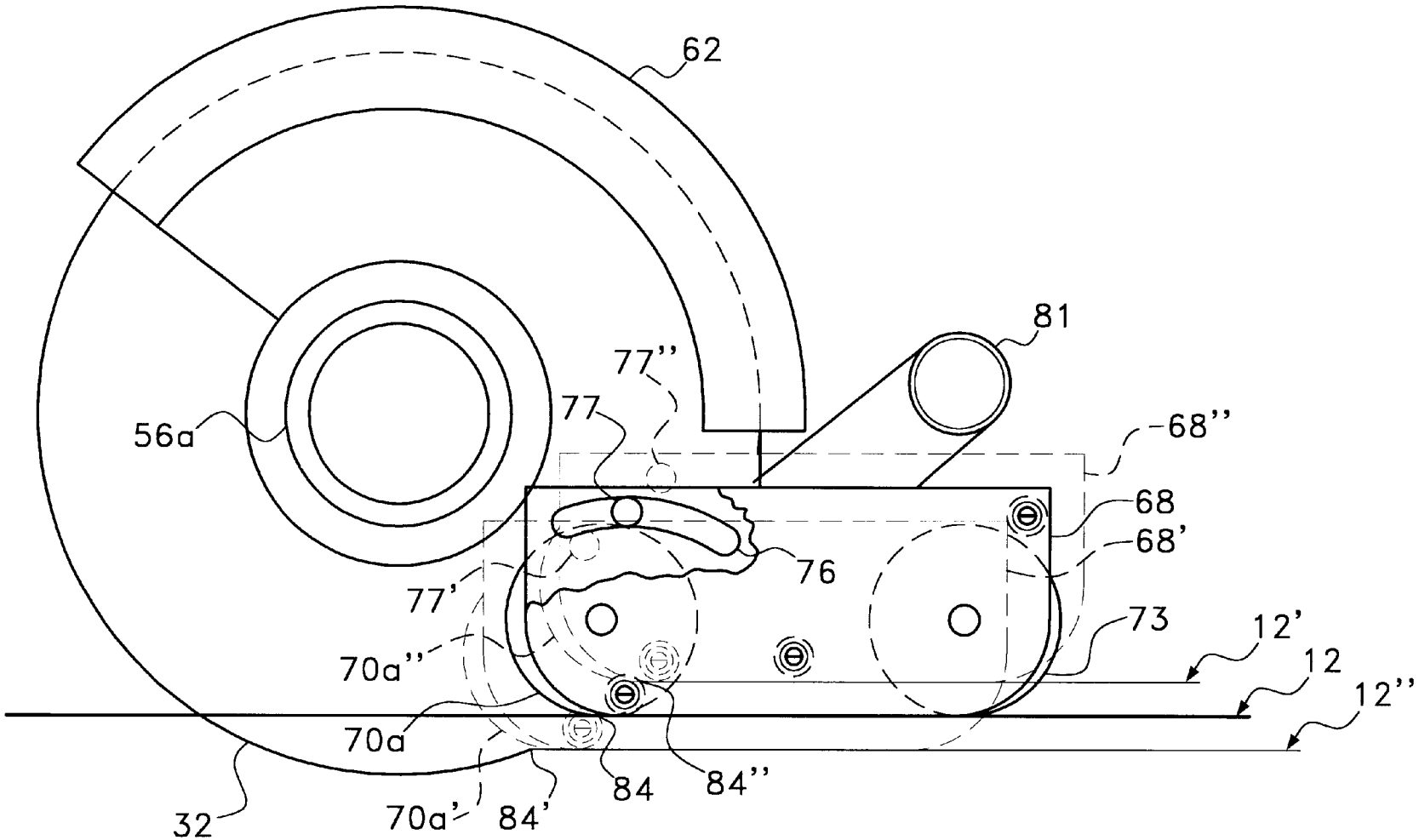
FIG. 7 is a side elevational view similar to FIG. 2 illustrating the up and down movement of the carriage with the anti-spalling rollers.

As best shown in FIG. 7, the anti-spalling rollers 70*a* and 70*b* are positioned to maintain contact with the concrete 12 along the concrete surface directly adjacent the saw blade 32 over an operative of cutting of from about ½ of an inch to 2½ inches of depth. However, greater or lesser depths of cut could be utilized if desired. As the depth of cut increases, the blade guard 62 is rotated counter-clockwise. The pivotal carriage connection 71 to the guard 62 allows the carriage 68 to rotate clockwise such that the anti-spalling rollers 70*a*, 70*b* and the forward roller 73 maintain contact with the surface being cut and also maintains the surface contact alignment of the anti-spalling rollers 70*a*, 70*b* at the location 84 where the saw blade 32 exits the concrete 12 over the operative cutting range. This is shown in FIG. 7, where the carriage 68 is shown in a lower operative position as 68' and in an upper operative position as 68". The exit locations are marked as 84' and 84", respectively. Contact of the anti-spalling rollers 70*a*, 70*b* with the concrete 12 at the blade exit location 84 minimizes damage to the concrete surface. The anti-spalling rollers 70*a* and 70*b*, should therefore preferably be located as close to the saw blade 32 as possible.

To aid in repairing any minor damage that does result from the blade 32, a vibrator which, for example may have an oscillating weight, can be fixed to the carriage 68. The vibrations, transferred through the structure to the roller 70*a* and 70*b*, act to tamp the concrete surface and repair any minor damage.

Referring again to FIG. 1, attached to the rear frame member 20 is handle assembly 88. The handle 88 is used to push the concrete saw 10 across the surface of the concrete 12. For large concrete slabs, a longer handle or handle extension can be added, if desired. A guide 23 extends from the front of the frame 14 for guiding the cut, for example along a chalk line.

As best shown in FIG. 2, a linkage 90 is provided for urging blade 32 into or withdrawing the blade 32 from the concrete 12. It is seen that all items supported on the blade assembly support 36, including the blade 32 and the prime mover 40, can pivot as a single unit about the support axle 38. As shown in FIGS. 1 and 2, the linkage 90 includes a rod 89 that is connected at a first end to the handle 88 and at the second end to the blade assembly support 36 by a support arm 91, spaced from the support axle 38. At the upper end of the handle 88, the first end of the rod 89 is pivotably connected to a control arm 92 via a pivot pin 93. The control arm 92 is itself pivotably mounted on a quadrant bracket 94 attached to the handle 88. The quadrant bracket 94 has a slot 95 in which a hand tightenable knob 96 on the control arm 92 rides. The knob 96 is tightened to hold the control arm 92 in a desired position.

As shown in detail in FIG. 2, a compression spring 97 is located in a linkage housing 98 connected to the second end of the rod 89. The second end of the rod 89 includes an enlarged head 99 that is also located in the housing 98 and which one end of the compression spring 97 bears against. The other end of the compression spring 97 bears against the opposite wall of the housing 98. The spring 97 is preferably pre-loaded.

The preferred time for cutting the concrete with the cutting device 10 is while the concrete is green. This is the time during which the concrete, having recently been poured, is still relatively soft, but hard enough to support the cutting device. In use, the operator loosens the knob 96 and pushes the control arm 92 forward to urge the saw blade 32 into the concrete to a desired depth of cut. The maximum depth of cut is limited by the slot 95 in the quadrant bracket 94. If the blade 32 hits an obstruction such as an entrained rock, or when the concrete saw 10 is moved forward too quickly, the blade 32 can move upwardly by compressing the spring 97 in the linkage housing 98. The spring 97 then urges the blade 32 downwardly to the preset level. While a preferred control linkage 90 has been described, those skilled in the art will recognize from the present disclosure that other suitable arrangements could be utilized, if desired.

A spotlight 101 may also be mounted to the frame to allow for day or night time operation.

Figure 8:
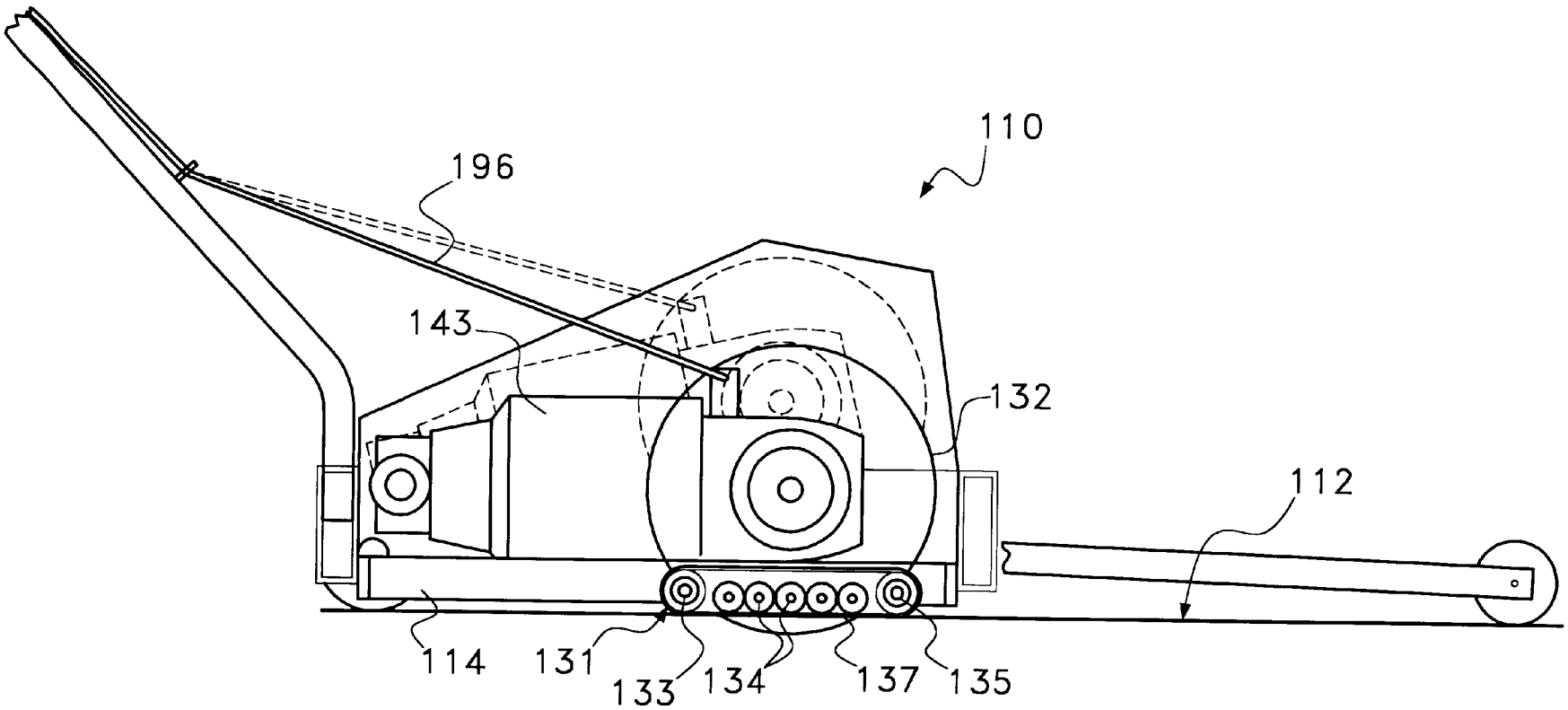
FIG. 8 is a side elevational view of another embodiment of a concrete saw in accordance with the present invention.

Referring to FIG. 8, an alternate embodiment of the saw 110 is shown. The saw 110 includes a frame 114 having wheels 126*a*–126*d*, similar to the first embodiment of the saw 110. However, the saw 110 utilizes a roller track 131 in place of the anti-spalling rollers 70*a*, 70*b* of the first preferred embodiment 10 to provide an anti-spalling hold down along the entire length of the blade 132. The roller track 131 comprises sprockets 133, 135 rotatably mounted on frame 114 passing over and spanning between the sprockets 133, 135 are tracks 137 to engage the concrete surface 112. The tracks 137 are smooth surfaced on the face in contact with the concrete 112 and can be made of rubber or other suitable material. Interspaced between the sprockets 133, 135 are idler wheels 139 for maintaining track contact with the concrete 112 along the length of the track 137 between the sprockets 133, 135. Two tracks 137 are provided, with one being located on each side of blade 132 and spanning the entire contact area between the blade 132 and concrete 112 while the cut is being made. A protective cover 141 is provided over the blade 132, which is preferably attached to a motor drive unit 143. The motor drive unit 143 is biased in a clockwise direction by a spring (not shown) to a position where the blade 132 engage the concrete 112. The control cable 196 is used to set the depth of cut in a similar manner to the first embodiment.

While particular embodiments of the present invention are disclosed herein, it is not intended to limit the invention to such disclosure, and changes and modifications may be incorporated and embodied within the scope of the following claims.

What is claimed is:

1. An apparatus for cutting concrete, comprising:

a frame having a plurality of support wheels located thereon;

a prime mover assembly connected to said frame;

a concrete cutting blade connected to said prime mover assembly and being mounted for generally upward and downward movement relative to said frame;

an adjustment mechanism for selectively adjusting said concrete cutting blade throughout an operating range of cutting depths, wherein at each of said cutting depths said concrete cutting blade defines a unique blade exit location;

an anti-spalling roller having a surface contact portion;

a carriage supporting said anti-spalling roller, the carriage being movably connected to said frame such that the carriage automatically positions said surface contact portion of said anti-spalling roller in alignment with said blade exit location for a selected cutting depth;

a guard mounted for pivotal movement around at least a portion of said concrete cutting blade;

a first stop element coupled to said carriage; and a second complementary coupled to said guard, wherein said first stop element and said second stop element to limit the travel of the carriage relative to the guard.

2. The apparatus of claim 1, further comprising a guard mounted for pivotal movement around at least a portion of said concrete cutting blade, and wherein the carriage is connected to the guard via a pivotal connection.

3. The apparatus of claim 2, wherein a forward roller is mounted on a carriage and a spring biases the carriage about the pivotal connection such that the forward roller the anti-spalling roller in alignment with the blade exit location.

4. The apparatus of claim 1, wherein a second anti-spalling roller is mounted to the carriage on an opposite side of the concrete cutting blade from the first roller.

5. The apparatus of claim 2, wherein the carriage includes a first stop element and the guard includes a second complementary stop element to limit the travel of the carriage relative to the guard.

6. The apparatus of claim 5, wherein the first stop element is an arcuate groove and the second complementary stop element is a pin which is located in the groove.

7. The apparatus of claim 1, wherein the concrete cutting blade rotates in an up-cut direction.

8. The apparatus of claim 1, further comprising a vibrating arrangement to vibrate the anti-spalling roller to prevent or repair damage to the surface during cutting.

9. The apparatus of claim 1, wherein the operative range of cutting depths is from about 0.5 of an inch to 2.5 inches.

10. The apparatus of claim 1, wherein four support wheels are located on the frame.

11. The apparatus of claim 1, wherein the anti-spalling rollers or the carriage width can be adjusted to accommodate different blade widths such that the anti-spalling roller is positionable adjacent to the blade with a minimum clearance.

12. The apparatus of claim 1, wherein a dust chute is connected to the carriage.

13. The apparatus of claim 1, further comprising a vibrator attached to the carriage.

14. An apparatus for cutting concrete, comprising:

a frame having a plurality of support wheels located thereon;

a prime mover assembly connected to said frame;

a concrete cutting blade connected to said prime mover assembly and being mounted for generally upward and downward movement relative to said frame;

an adjustment mechanism for selectively adjusting said concrete cutting blade throughout an operating range of cutting depths, wherein at each of said cutting depths said concrete cutting blade defines a unique blade exit location;

a first anti-spalling roller having a first surface contact portion;

a second anti-spalling roller having a second surface contact portion; and a carriage supporting said first anti-spalling roller on one side of said concrete cutting blade and a second anti-spalling roller on an opposite side of said concrete cutting blade, the carriage being movably connected to said frame such that the carriage automatically positions said first surface contact portion of said first anti-spalling roller and said second surface contact portion of said second anti-spalling roller in alignment with said blade exit location for a selected cutting depth.

15. An apparatus for cutting concrete, comprising:

a frame having a plurality of support wheels located thereon;

a prime mover assembly connected to said frame;

a concrete cutting blade connected to said prime mover assembly and being mounted for generally upward and downward movement relative to said frame;

an adjustment mechanism for selectively adjusting said concrete cutting blade throughout an operating range of cutting depths, wherein at each of said cutting depths said concrete cutting blade defines a unique blade exit location;

an anti-spalling roller having a surface contact portion;

a vibrating arrangement to vibrate the anti-spalling roller; and a carriage supporting said anti-spalling roller, the carriage being movably connected to said frame such that the carriage automatically positions said surface contact portion of said anti-spalling roller in alignment with said blade exit location for a selected cutting depth.

* * * * *